US005372299A

United States Patent [19]

Edgerton, Jr. et al.

[11] Patent Number: 5,372,299

[45] Date of Patent: Dec. 13, 1994

[54] COMBINED PRODUCT SHIPPING AND DISPLAY BOX

[75] Inventors: Eric Edgerton, Jr.; John D. Jannone, both of Hackettstown, N.J.; Kenneth Whelan, Richmond, Va.; William C. Bauer, Baltimore, Md.

[73] Assignee: BASF Corporation, Parsippany, N.J.

[21] Appl. No.: 135,220

[22] Filed: Oct. 12, 1993

[51] Int. Cl.[5] ..... B65D 5/48

[52] U.S. Cl. ..... 229/120.18; 206/427; 229/164; 229/191; 229/918; 229/919

[58] Field of Search ..... 229/120.18, 164, 191, 229/918, 919; 206/427

[56] References Cited

U.S. PATENT DOCUMENTS

| | | | |
|---|---|---|---|
| D. 110,200 | 4/1938 | Sunderhauf . | |
| D. 172,949 | 9/1954 | Clancy . | |
| D. 240,506 | 7/1976 | Congleton . | |
| 2,334,902 | 1/1942 | Buttery . | |
| 3,009,622 | 11/1961 | Leone . | |
| 3,079,058 | 2/1963 | Russell | 229/919 |
| 3,159,326 | 12/1964 | Stonebanks | 229/120.18 |
| 3,536,246 | 10/1970 | Rosen | 229/120.18 |
| 3,756,385 | 9/1973 | Steinbock . | |
| 4,056,223 | 11/1977 | Williams | 229/191 |
| 4,119,202 | 10/1978 | Roth . | |
| 4,341,338 | 7/1982 | Arnold | 229/919 |
| 4,363,400 | 12/1982 | Lewis . | |
| 4,579,220 | 4/1986 | Brundage . | |
| 4,607,750 | 8/1986 | Valenti | 206/427 |
| 4,638,941 | 1/1987 | Watson . | |
| 4,676,429 | 6/1987 | Crowe et al. . | |
| 4,705,162 | 11/1987 | Kupersmit . | |
| 4,871,067 | 10/1989 | Valenti | 206/427 |
| 4,919,270 | 4/1990 | Govang et al. . | |
| 4,948,033 | 8/1990 | Halsell, II et al. | 229/918 |
| 5,016,761 | 5/1991 | Stoddard et al. . | |
| 5,035,323 | 7/1991 | Daniels et al. . | |
| 5,261,594 | 11/1993 | Brown et al. | 229/191 |

*Primary Examiner*—Gary E. Elkins
*Attorney, Agent, or Firm*—Nixon & Vanderhye

[57] ABSTRACT

A combined shipping and display box is provided which is formed from a one-piece blank of box-board material configured such that, when erected, the box will include bottom, front and rear walls as well as an opposed pair of side walls. The side walls are each formed from respective side panels having a central sub-panel and a pair of divider sub-panels extending in opposite directions from the central sub-panel. These divider sub-panels are inwardly foldable onto their respective central sub-panel along predetermined fold lines so as to not only be positioned in adjacent contact with the central sub-panel, but also to establish protruding interior dividers for the shipping/display box. When erected, therefore, the terminal edges of each respective pair of divider sub-panels will abut one another such that each of the interior dividers is paired with a similar interior divider associated with the opposite side wall. In such a manner, therefore, the paired dividers will establish box positions adapted to hold a selected number of prepackaged product containers in a desired array. The dividers, moreover, protect the prepackaged product containers held thereby against movement (and hence potential damage) during shipping.

16 Claims, 4 Drawing Sheets

COMBINED PRODUCT SHIPPING AND DISPLAY BOX

RELATED APPLICATIONS

This application is related to commonly owned U.S. design patent application Ser. No. 29/014,093 filed even date herewith in the name of the same inventors as this application and entitled "Design For: Combined Product Shipping and Display Box", the entire content of which is expressly incorporated hereinto by reference.

FIELD OF THE INVENTION

This invention is generally related to boxes by which consumer products may be shipped safely by a manufacturer to a point-of-purchase retailer, and then efficiently displayed in an aesthetically pleasing manner at such point-of-purchase.

BACKGROUND AND SUMMARY OF THE INVENTION

Many products are individually packaged for sale to the ultimate consumer. Such prepackaged products, however, are typically shipped to the point-of-purchase retailer in bulk form—i.e., within their own shipping box. Of course, it is quite important for the product manufacturer to devise a shipping box which ensures that the prepackaged product will not be damaged in transit. It is also quite important for the product to be displayed in an efficient and aesthetically pleasing manner so as to attract consumer awareness. Oftentimes, the point-of-purchase retailer will physically remove the prepackaged products from their shipping box and place them on store shelves and/or in stacked island displays on the sales floor.

Those in this art have, however, endeavored to provide shipping assemblies which also serve as product displays at the point-of-purchase, as evidenced, for example, by U.S. Pat. No. 4,119,202 to Roth and U.S. Pat. No. 4,579,220 to Brundage. While the combined shipping and display assemblies proposed in the art are satisfactory for many prepackaged products, other products, such as prepackaged containers of flowable (e.g., fluid or granulated) product require special packaging considerations. It is therefore towards providing a combined shipping and display box which is especially adapted for use with prepackaged containers of flowable product that the present invention is directed.

According to the present invention, a combined shipping and display box is provided which is formed form a one-piece blank of box-board material configured such that, when erected, the box will include bottom, front and rear walls as well as an opposed pair of side walls. More specifically, the side walls are each formed from respective side panels having a central sub-panel and a pair of divider sub-panels extending in opposite directions from the central sub-panel. These divider sub-panels are inwardly foldable onto their respective central sub-panel along predetermined fold lines so as to not only be positioned in adjacent contact with the central sub-panel, but also to establish protruding interior dividers for the shipping/display box.

When erected, therefore, the terminal edges of each respective pair of divider sub-panels will abut one another such that each of the interior dividers is paired with a similar interior divider associated with the opposite side wall. In such a manner, therefore, the paired dividers will establish box positions adapted to hold a selected number of prepackaged product containers in a desired array. The dividers, moreover, protect the prepackaged product containers held thereby against movement (and hence potential damage) during shipping.

Further aspects and advantages of this invention will become more clear from the following detailed discussion of the preferred exemplary embodiment thereof.

BRIEF DESCRIPTION OF THE ACCOMPANYING DRAWINGS

Reference will be made to the accompanying drawings, wherein like reference numerals throughout the various FIGURES denote like structural elements, and wherein, FIG. 1 is a front perspective view of an exemplary embodiment of the combined product shipping and display box according to this invention; and FIGS. *2a–2e* sequentially depict the manner in which the exemplary combined product shipping and display box according to this invention is erected from a box-board blank.

DETAILED DESCRIPTION OF THE PREFERRED EMBODIMENTS

Figure 1:
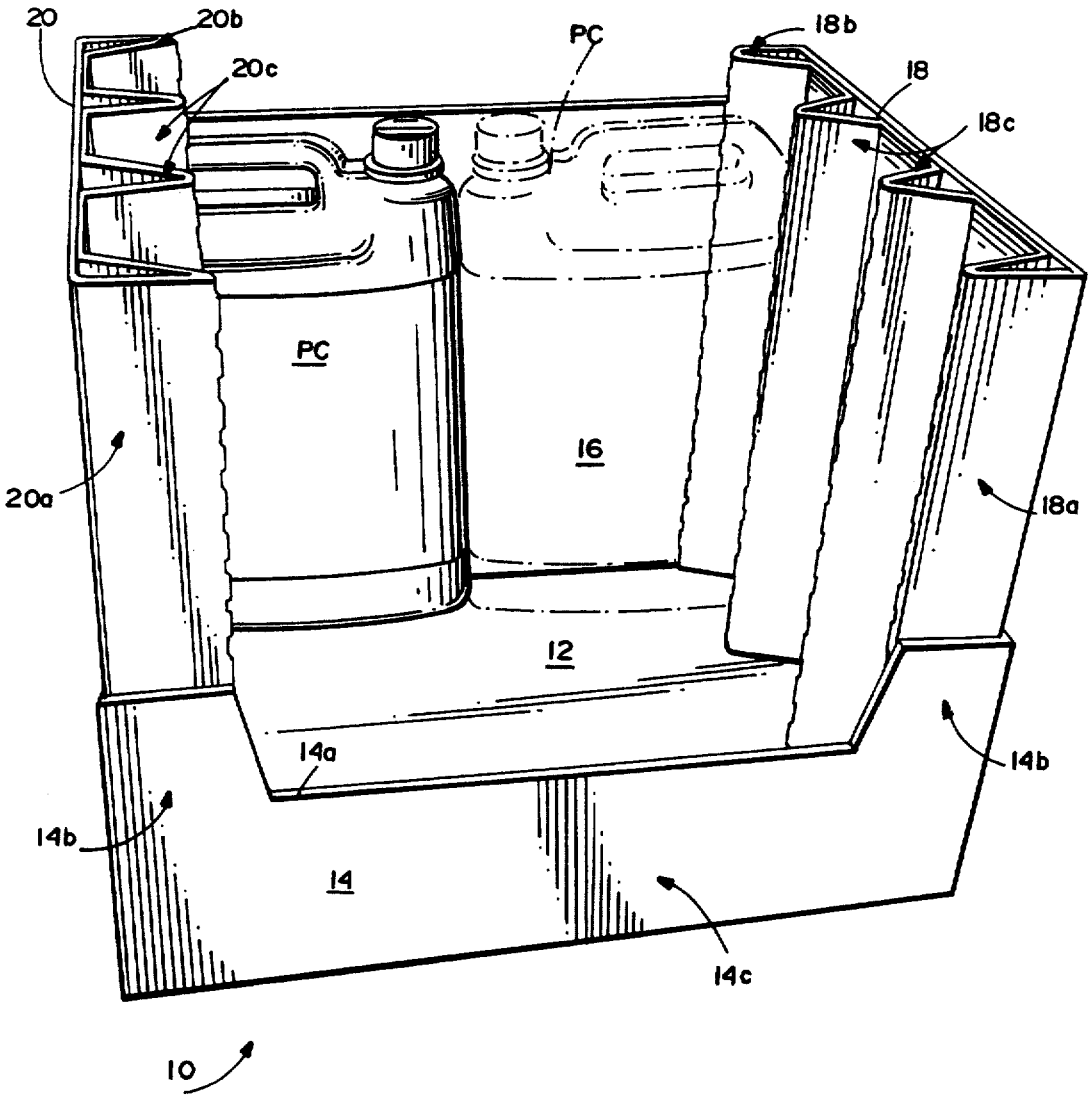
Figure 2A:
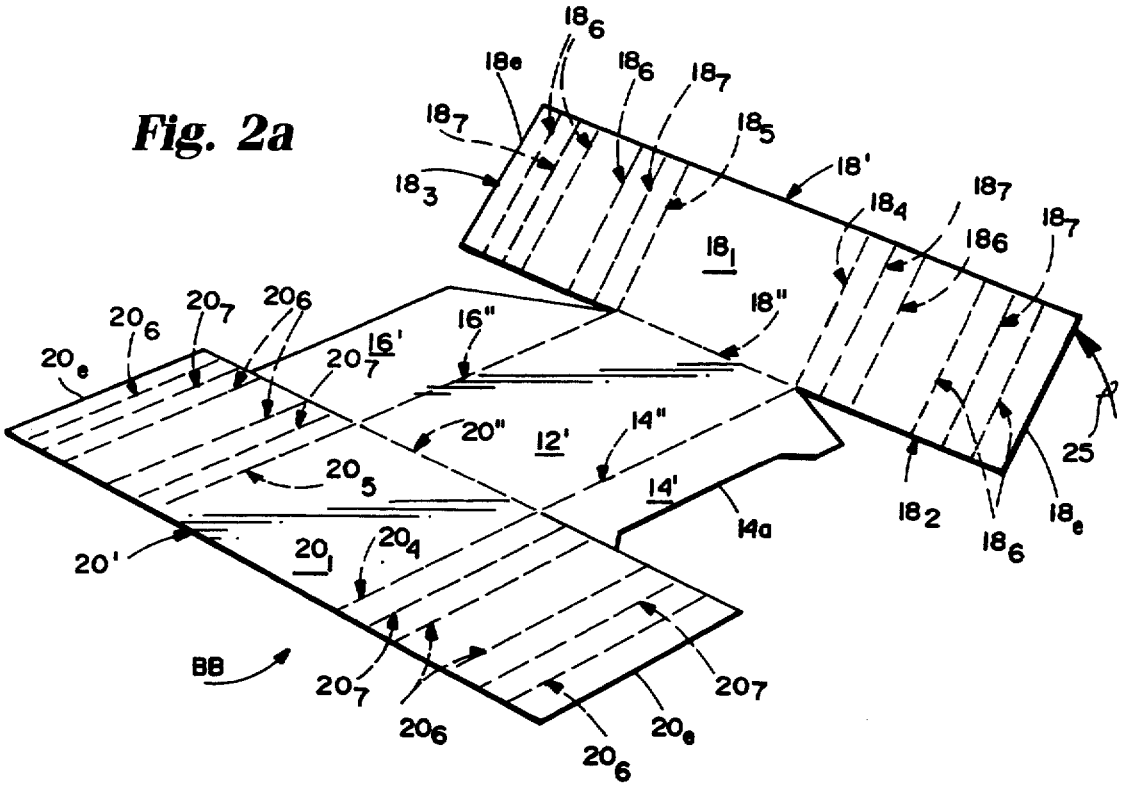
Figure 2B:
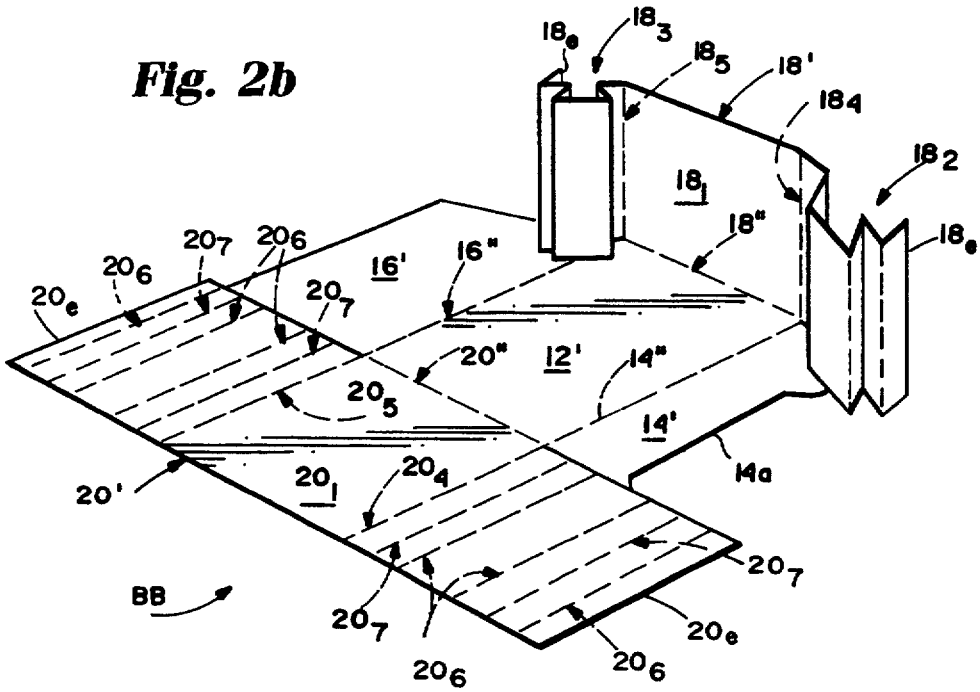
Figure 2C:
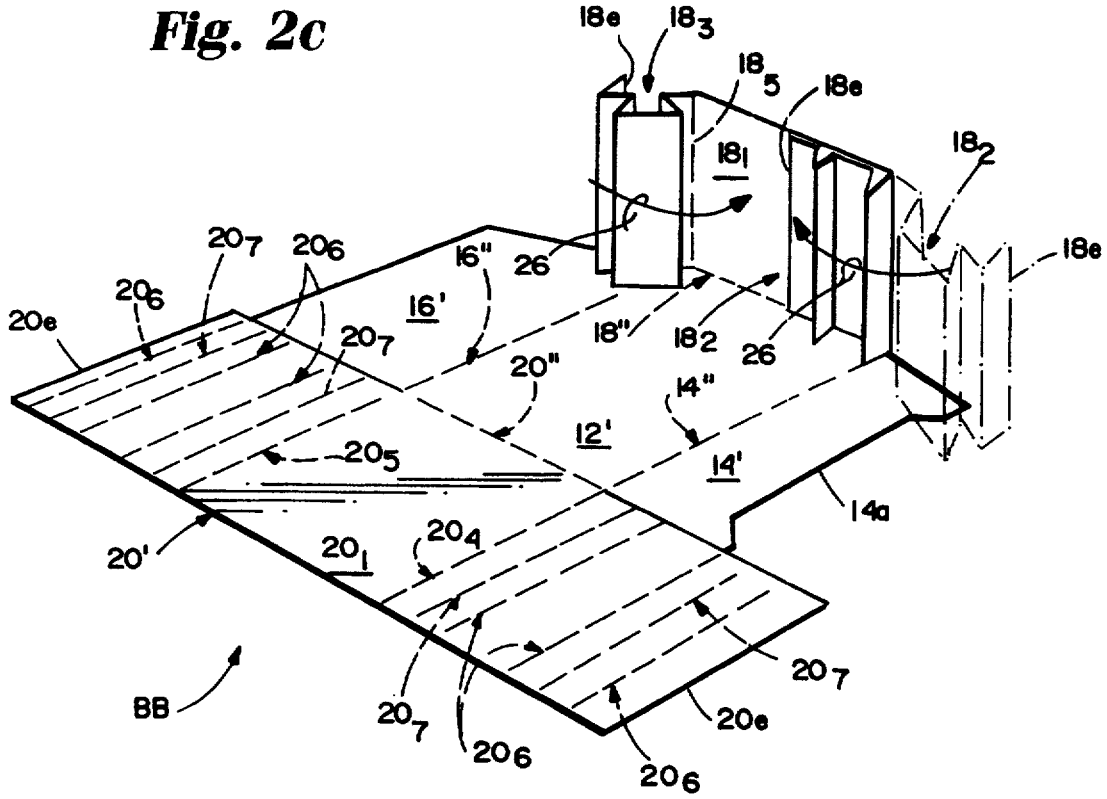
Figure 2D:
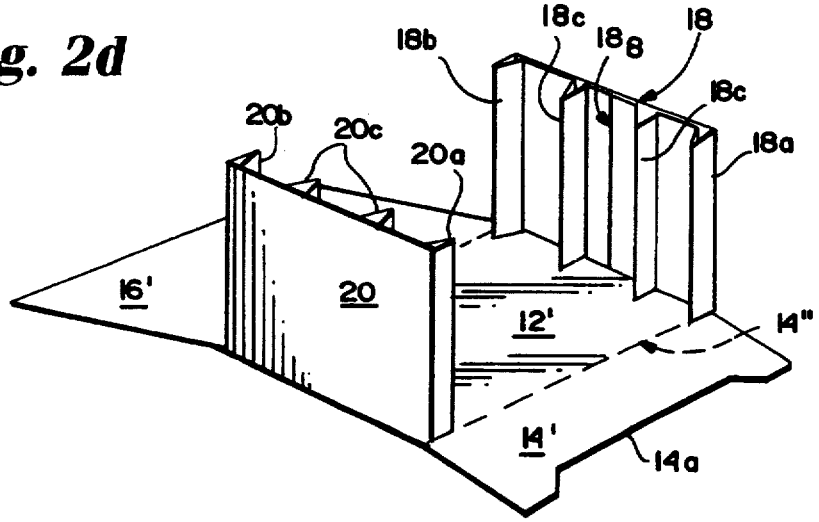
Figure 2E:
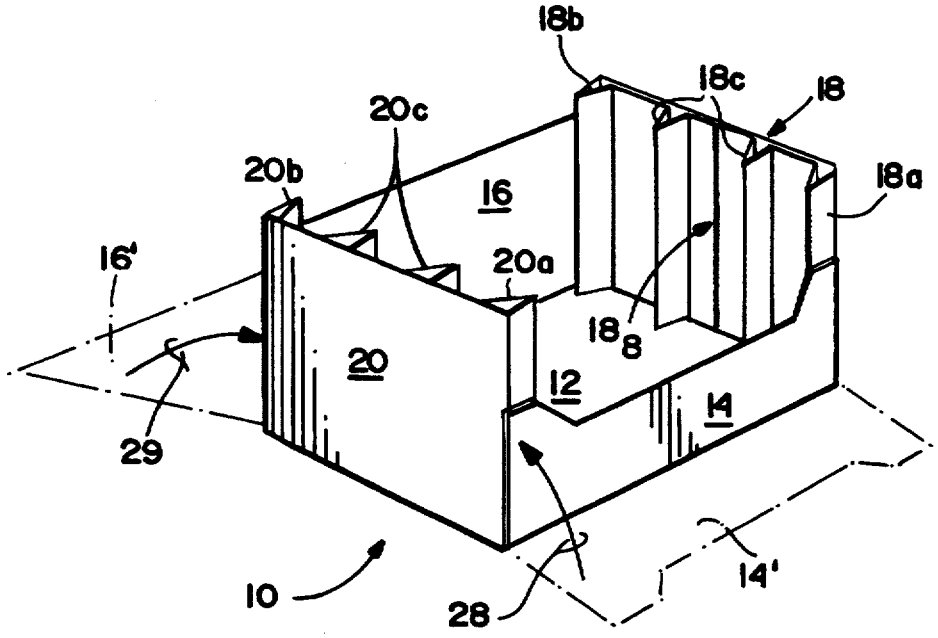

A particularly preferred exemplary embodiment of the combined product shipping and display box 10 (hereinafter more simply referred to as "the box") according to this invention is shown in accompanying FIG. 1. The box 10 includes a bottom wall 12, a front wall 14, a rear wall 16, and an opposed pair of side walls 18, 20, respectively.

The side walls 18, 20, are each provided with a series of spaced-apart, inwardly protruding dividers which, in the preferred embodiment, include forward and rearward dividers **18*a*, 18*b* and 20*a*, 20*b*, as well as interior dividers 28*c*, 20*c*, respectively. These opposed paired dividers 18*a*–18*c* and 20*a*–20*c* will thus segregate the interior volume of the box 10 into compartments which are sized and configured to accept therewithin a side-by-side pair of product prepackaged product containers PC. It will be understood, however, that the dividers 18*a*–18*c* and 20*a*–20*c* in the exemplary embodiment shown in FIG. 1** will allow for 2 by 3 array of product containers PC. However, those skilled in the art will recognize that the structural/functional features of this invention could be incorporated into boxes which allow for other product container arrays (e.g., m by n arrays, where m and n are each whole numbers).

The front wall 14 is secured to exterior surface regions of the front dividers **18*a* and 20*a*, by any suitable means such as glue, staples, tape or the like. Similarly, the rear wall 16 is secured to the exterior surface regions of the rear dividers 18*b* and 20*b*. Preferably, the rear wall 16 is of a height which corresponds closely to the height of the product containers PC, and thus can extend to the entire height of the rear dividers 18*b*, 20*b*. The front wall 14, on the other hand, has a height which is most preferably substantially less than the height of the product containers. This reduced height may be achieved by providing a recessed top edge portion 14*a* laterally between the front dividers 18*a*, 20*a* so as to establish end sections 14*b* having a height substantially greater than the height of the middle section 14*c* immediately below the top edge 14*a*. In this manner, the end sections 14*b* will provide structural support for the front wall, while the reduced-height middle section 14*c* will permit the product containers PC to be more visible to consumers when the container 10** is on display.

Accompanying FIGS. *2a–2e* sequentially show the manner in which the box 10 is erected from a box-board blank BB. As is perhaps depicted most clearly in FIG. *2a*, the blank BB includes a bottom wall panel 12' to which are connected front and rear wall panels 14' and 16' along front and rear fold lines 14'' and 16'', respectively. Thus, the bottom, front and rear wall panels, 12' 14' and 16' will, upon erection of the blank BB, form the bottom, front and rear walls 12, 14 and 16, respectively.

The side walls 18, 20 are formed from respective side panels 18', 20', each of which includes a central sub-panel $18_1$, $20_1$ and a pair of divider sub-panels $18_2$, $18_3$ and $20_2$, $20_3$, respectively. The central sub-panels $18_1$, $20_2$ are each joined integrally to the bottom wall panel 12' along parallel lateral fold lines 18'' and 20'', respectively. The divider sub-panels $18_2$, $18_3$ and $20_2$, $20_3$ are in turn integrally connected to the central sub-panels $18_1$, $20_1$ along parallel forward and rearward fold lines $18_4$, $18_5$ and $20_4$, $20_5$ which are linearly coincident with front and rear fold lines 14'', 16'', respectively.

As will be described in greater detail below, the dividers 18a–18c and 20a–20c are each formed by means of a series of base fold lines $18_6$, $20_6$ and apex fold lines $18_7$, $20_7$ disposed between the base fold lines $18_6$, $20_6$. As can be seen, the series of base fold lines $18_6$, $20_6$ and apex fold lines $18_7$, $20_7$ are aligned in parallel to one another transversely relative to the side panels 18', 20' (i.e., so as to be disposed substantially vertically when the box 10 is erected). In such a manner, each of the dividers 18a–18c and 20a–20c will be generally triangularly shaped. However, those skilled in this art will understand that dividers having a rectangular (or other non-triangular geometric shape) could be formed if desired simply by providing at least one additional apex fold line $18_7$, $20_7$.

In order to erect the box 10 according to this invention, one of the side panels—for example, side panel 18' shown in FIG. *2a*—is first folded upwardly (arrow 25 in FIG. *2a*) along fold line 18''. Thereafter, the front and rear divider sub-panels $18_2$, $18_3$, respectively, are folded along the fold lines $18_6$ and $18_7$ in the manner shown in FIG. *2b*. Thereafter, each of the divider sub-panels $18_2$, $18_3$ may be folded inwardly toward one another along fold lines $18_4$ and $18_5$ as depicted by arrows 26 in FIG. *2c*. The terminal edges $18_0$ of the divider sub-panels $18_2$, $18_3$ will thus be butted against one another along a substantially vertical abutment line $18_8$ (see FIG. *2d*). Thus, those portions of the divider sub-panels $18_2$, $18_3$ which are disposed between adjacent ones of the dividers 18a–18c will be in contact against the central sub-panel $18_1$. As such the side wall 18 will have an effective thickness which is essentially twice the thickness of the box-board blank.

The discussion above is similarly applicable to the manner in which the side panel 20' is erected. That is, the side panel 20' is folded along fold lines 20'' and $20_4$–$20_7$ in a manner similar to that discussed above with respect to fold lines 18'' and $18_4$–$18_7$ associated with the side panel 18' so that the terminal edges $20_0$ thereof will be brought into abutment with one another.

Once both side panels 18' and 20' have been folded in the manner described above so as to form side walls 18 and 20 (i.e., as shown in FIG. *2d*), respectively, final erection of the box 10 can then be accomplished by folding the front and rear panels 14' and 16', respectively, in the manner shown in FIG. *2e*. That is, the front and rear panels 14' and 16' are each folded in the direction of arrows 28, 29 in FIG. *2e* and secured to respective exterior face portions of the front and rear dividers 18a, 20a and 18b, 20b (e.g., by means of glue, box-board staples, tape or the like. The individual product containers PC may then be positioned between opposed ones of the dividers 18a–18c and 20a–20c.

Although not shown in the accompanying drawing, the box 10 may be provided with a box-board cover or lid so as to completely house the product containers PC held within the box interior space. Alternatively, or additionally, a "shrink-wrap" plastics film may be provided as a cover for the product container-filled box 10. This latter proposal may be more desirable (particularly in the absence of a box-board cover or lid), since the product logo/trademark on the individual product containers PC would then be visible through the plastics film for easy box identification.

In addition, the fold lines mentioned above could, if desired be perforated or scored so as to assist in folding the box board BB when erecting the box 10 according to this invention. Thus, as shown in FIG. 1 the apex fold lines $18_7$, $20_7$ are depicted as being perforated as an example.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combined shipping and display box for prepackaged product containers comprising:

a bottom wall, opposed front and rear walls joined to said bottom wall along respective front and rear fold lines, and an opposed pair of side walls each joined to said bottom wall along a respective lateral fold line; wherein said side walls include number of spaced-apart inwardly protruding product container dividers such that said dividers of one said side walls are in opposition to said dividers of the other said side wall to thereby establish a space for receiving at least one prepackaged product container therebetween; and wherein each said side wall includes a central sub-panel and a pair of divider sub-panels each of which has a terminal edge at one end thereof, and is joined to and extends outwardly from said central sub-panel at another end thereof along one of forward and rearward fold lines which linearly coincide with said front and rear fold lines, respectively;

said divider sub-panels also having a series of parallel fold lines so as to form respective ones of said product container dividers; wherein each said divider sub-panel being folded inwardly along said respective forward and rearward fold lines so as to be disposed against said central sub-panel in such a manner that said terminal edges thereof abut one another.

2. A combined product shipping and display box as in claim 1, wherein said product container dividers are substantially triangularly shaped.

3. A combined product shipping and display box as in claim 1, wherein said front wall has a recessed cut-out portion between forward ones of said product container dividers.

4. A combined product shipping and display box as in claim 3, wherein said front wall has a height substantially less than the product container height.

5. A combined product shipping and display box as in claim 1, wherein said rear wall has a height which is at least about the same height as the product containers.

6. A combined product shipping and display box as in claim 1, wherein at least some of said fold lines are perforated.

7. A combined product shipping and display box as in claim 1, wherein at least some of said fold lines are scored.

8. A combined product shipping and display box as in claim 1, wherein at least interior ones of said product container dividers are established by a pair of spaced-apart base fold lines and an apex fold line disposed between said base fold lines.

9. A one-piece box-board blank which erected forms a box holding a number of prepackaged product containers, said blank comprising:

a bottom wall panel;

front and rear wall panels attached to said bottom wall panel along respective longitudinally spaced-apart parallel front and rear fold lines; and an opposed pair of side wall panels attached to said bottom wall panel along respective latitudinally spaced-apart side fold lines; wherein said pair of side wall panels each include, a central sub-panel connected to said bottom panel along a respective one of said side fold lines; and a pair of divider sub-panels which have a terminal edge at one end thereof, and are joined to and extend outwardly from said central sub-panel at another end thereof along forward and rearward fold lines which linearly coincide with said front and rear fold lines, respectively, wherein;

a. said divider sub-panels include a series of fold lines disposed between and parallel to said forward and rearward fold lines; and wherein b. said divider sub-panels are foldable along said forward, rearward and series of fold lines so as to (i) allow said divider sub-panels to be folded inwardly against their respective said central sub-panel such that said terminal edges of said opposed pair of divider sub-panels abut one another, and (ii) form a number of product container dividers which protrude inwardly from a respective said side wall and are opposed to corresponding product container dividers protruding inwardly from the other said side wall, whereby the product containers may be held thereby.

10. A box-board blank as in claim 9, wherein at least some of said series of fold lines include a pair of spaced-apart base fold lines and an apex fold line.

11. A box-board blank as in claim 10, wherein said series of fold lines serve to form product dividers which are generally triangularly shaped.

12. A box-board blank as in claim 9, wherein at least some of said fold lines in said series of fold lines are perforated.

13. A box-board blank as in claim 9, wherein at least some of said fold lines in said series of fold lines are scored.

14. A box-board blank as in claim 9, wherein said front wall panel has a dimension such that, when erected, said front wall panel will be a height substantially less than the height of the product containers held within the box.

15. A box-board blank as in claim 9, wherein said rear wall panel has a dimension such that, when erected, said rear wall panel will be a height which is at least substantially the same height as the product containers held within the box.

16. A box-board blank as in claim 9, wherein said front wall panel has an opposite said front fold line which includes a cut-out portion.

* * * * *